US005884447A

United States Patent [19]

Earp

[11] Patent Number: 5,884,447

[45] **Date of Patent: *Mar. 23, 1999**

[54] PANEL SUPPORT DEVICE

[76] Inventor: Michael John Earp, 2 Croasdaile Rd., Stansted, Essex CM24 8DN, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 624,383

[22] PCT Filed: Sep. 22, 1994

[86] PCT No.: PCT/GB94/02065

§ 371 Date: Apr. 1, 1996

§ 102(e) Date: Apr. 1, 1996

[87] PCT Pub. No.: WO95/09956

PCT Pub. Date: Apr. 13, 1995

[30] Foreign Application Priority Data

Oct. 4, 1993 [GB] United Kingdom ..... 9320379

[51] Int. Cl.[6] ..... E04B 2/82; E04F 21/00

[52] U.S. Cl. ..... 52/489.1; 52/127.1; 52/127.8; 52/714; 52/749.11; 248/300; 248/544

[58] Field of Search ..... 52/489.1, 506.09, 52/514, 127.1, 127.2, 127.6, 127.8, 714, 749.11, DIG. 1; 248/300, 317, 544

[56] References Cited

U.S. PATENT DOCUMENTS

| | | | |
|---|---|---|---|
| 2,575,595 | 11/1951 | Rienecker | 248/300 X |
| 4,021,979 | 5/1977 | Rez | 52/127.1 |
| 4,112,636 | 9/1978 | Hays | 52/489.1 X |
| 4,449,338 | 5/1984 | Reicherts | 52/127.8 |
| 4,467,578 | 8/1984 | Weinar | 52/714 X |
| 4,709,460 | 12/1987 | Luhowyj | 248/544 X |
| 4,782,642 | 11/1988 | Conville | 52/514 X |
| 4,867,403 | 9/1989 | Anderson . | |
| 5,131,205 | 7/1992 | Hermann | 52/127.1 X |
| 5,170,976 | 12/1992 | Lundman | 248/300 |
| 5,224,309 | 7/1993 | Bodell | 52/127.1 |
| 5,385,194 | 1/1995 | Brown | 52/489.1 X |
| 5,581,964 | 12/1996 | Pizer | 52/712 X |

FOREIGN PATENT DOCUMENTS

| | | |
|---|---|---|
| 0346002 | 12/1989 | European Pat. Off. . |
| 8512269 | 7/1985 | Germany . |
| 2236349 | 4/1991 | United Kingdom . |
| 2238072 | 5/1991 | United Kingdom . |

*Primary Examiner*—Carl D. Friedman
*Assistant Examiner*—Winnie S. Yip
*Attorney, Agent, or Firm*—Fildes & Outland, P.C.

[57] ABSTRACT

A device (1) for supporting a second panel in edge-to-edge relationship with a fixed panel, the support device (1) including a support plate (2), means (16) to permit the support plate (2) to be attached against the fixed panel, and means (4) for aligning the support plate (2) to overhang the fixed panel by an amount sufficient to support the second panel in the said relationship. The support plate may include a lip (5) to assist in placing the second panel on the support plate (2).

25 Claims, 10 Drawing Sheets

PANEL SUPPORT DEVICE

The present invention relates to a device for supporting a second panel in edge-to-edge relationship with a fixed panel. In particular, the preferred embodiment of the invention relates to the device for assisting in the fixing of plasterboard and other sheet materials to walls, ceilings and partitions.

Walls, ceilings and partitions of many buildings incorporate plasterboard which leaves a smooth surface to the wall or ceiling. Plasterboard is much easier, quicker and less messy to erect than wet plaster is to apply. Since plasterboard is supplied in flat panels, a plasterboard fixer must cut the panel to a desired size and attach it to the wall, ceiling or partition usually by means of screws or nails.

A framework is usually constructed to suit the dimensions of the panel so that the very edge of the fixed panel is supported by a frame member to which the panel is fixed. The framework is usually made from metal or wood.

Plasterboard is quite brittle and will easily snap under its own weight if not supported correctly. Plasterboard panels are difficult to support correctly whilst being offered up to the framework, particularly if the panel is to be fixed to a ceiling. Furthermore, larger plasterboard panels are difficult to handle since they are very heavy. A plasterboard fixer will offer the panel into the desired position using two hands to give adequate support. The plasterboard fixer must then remove one hand to hold a hammer or screwdriver and the other hand to hold a nail or screw in order that the panel may be fixed into position. During the fixing of the panel, the fixer will often use his head to support the panel. The fixer may also use temporary propping e.g. a "deadman". This has the disadvantages that the panel may move during the attachment leaving large or uneven gaps between adjacent panels, or the panel is in danger of damage due to incorrect support.

These disadvantages apply for example, to fixing plasterboard to walls, ceilings, soffits and partitions.

It is an object of the present invention to overcome or at least reduce some of the above disadvantages.

One aspect of the present invention is a device for supporting a second panel in edge to edge relationship with a previously fixed panel, the support device including a support plate, means to permit the support plate to be attached against the fixed panel, and means for aligning the support plate to overhang the fixed panel by an amount sufficient to support the second panel to be fixed in the said relationship.

Preferably the support plate includes a lip to assist in placing the second panel, to be fixed, on the support plate.

Preferably also, the alignment means aligns the support plate so that the attachment permitting means is aligned with the fixed panel.

According to the preferred embodiment, the means to permit the support plate to be attached against the fixed panel includes holes through the support plate.

It is an advantage to further include spacer means disposed on the support plate for spacing the support plate from the fixed panel. Normally the fixed panel is fixed against a support member and the spacer means spaces the support plate away from the fixed panel to assist in placing the second panel between the support plate and the support member.

Preferably the alignment means includes a flange extending from the support plate and disposed across the support plate to abut against the edge of the fixed panel.

In most situations, the edge of the fixed panel is fixed to a frame member of a framework so that the frame member overlaps the edge of the fixed panel and the device is attached directly to the frame member through the fixed panel.

Preferably the alignment means aligns the support plate so that the attachment permitting means permits the device to be attached to the framework member.

The device may be provided with a handle or hook, preferably at one end thereof, for example, by bending part of the support plate into a U-shaped portion or by providing a separate handle attached to the support plate.

Further, the device may include means by which the device can be levered from a fixed panel to which it is temporarily secured. Such means may be at one end of the device and may comprise an extension of the support plate protruding therefrom. Alternatively, said lever means may be formed as an extension of a separately formed handle attached to and extending along the underside of the support plate, in which case, that extension may be located at the end of the device remote from the U-shaped portion of the handle.

According to another embodiment, the support and alignment means are integrally formed and/or the support plate and spacer means are integrally formed.

The support device may be constructed from metal, plastics or other material either in the form of sheets, extrusions or mouldings.

The support device is particularly useful when it is adapted for assisting in supporting plasterboard panels on walls or ceilings or for assisting in supporting partition panels.

Another aspect of the invention resides in a method of supporting a second panel in edge to edge relationship with a fixed panel using a device in accordance with the invention, which method comprises attaching the support plate against the fixed panel, aligning the support plate to overhang the fixed panel by an amount sufficient to support the second panel in edge to edge relationship with the fixed panel, and placing the second panel on the support plate, so that the second panel is supported by the device in edge to edge relationship with the fixed panel.

An embodiment of the present invention and some of its applications are now described by way of example only with reference to the drawings in which.

Figure 1:
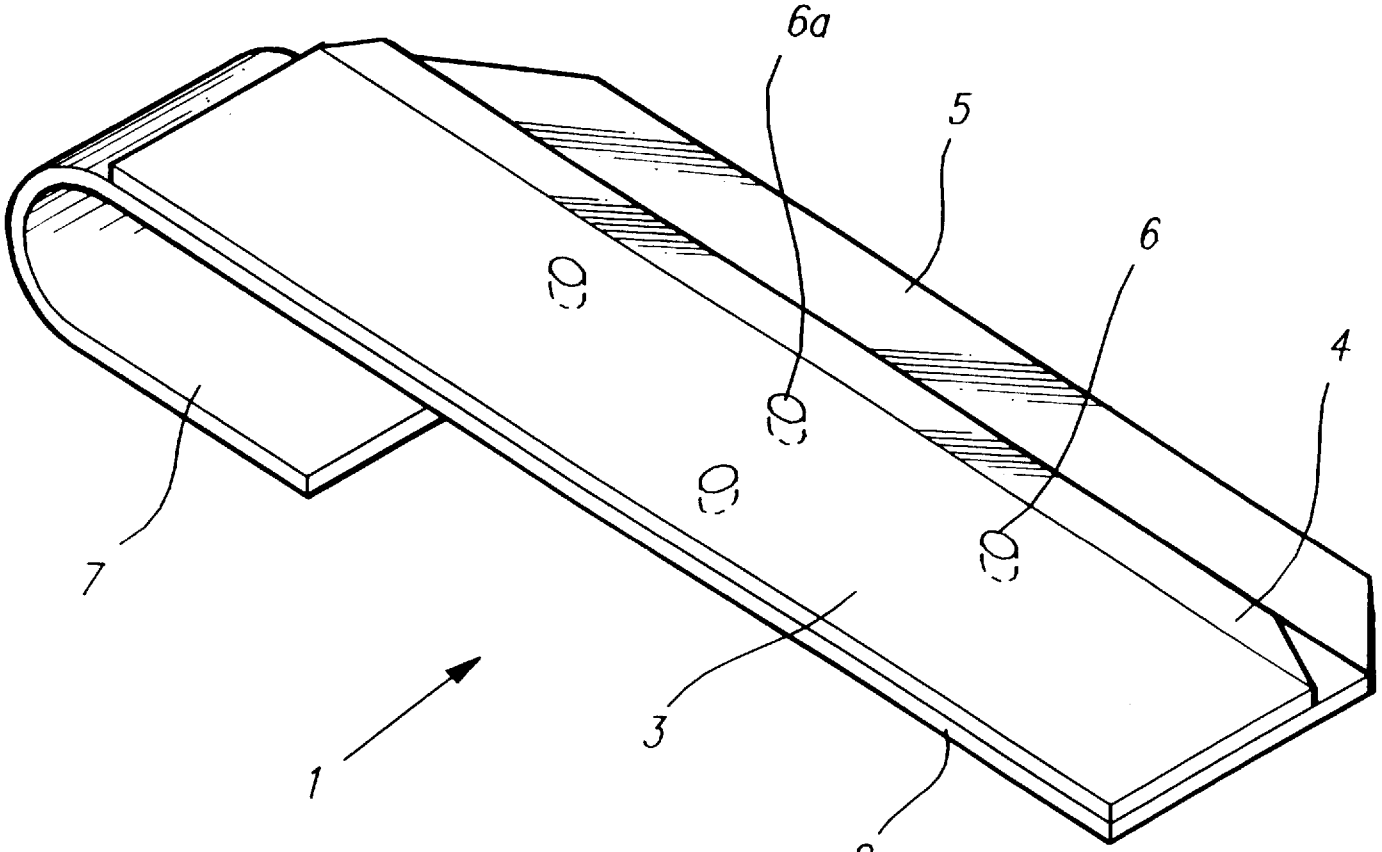
FIG. 1 shows a perspective view of the device according to the invention.
Figure 2:
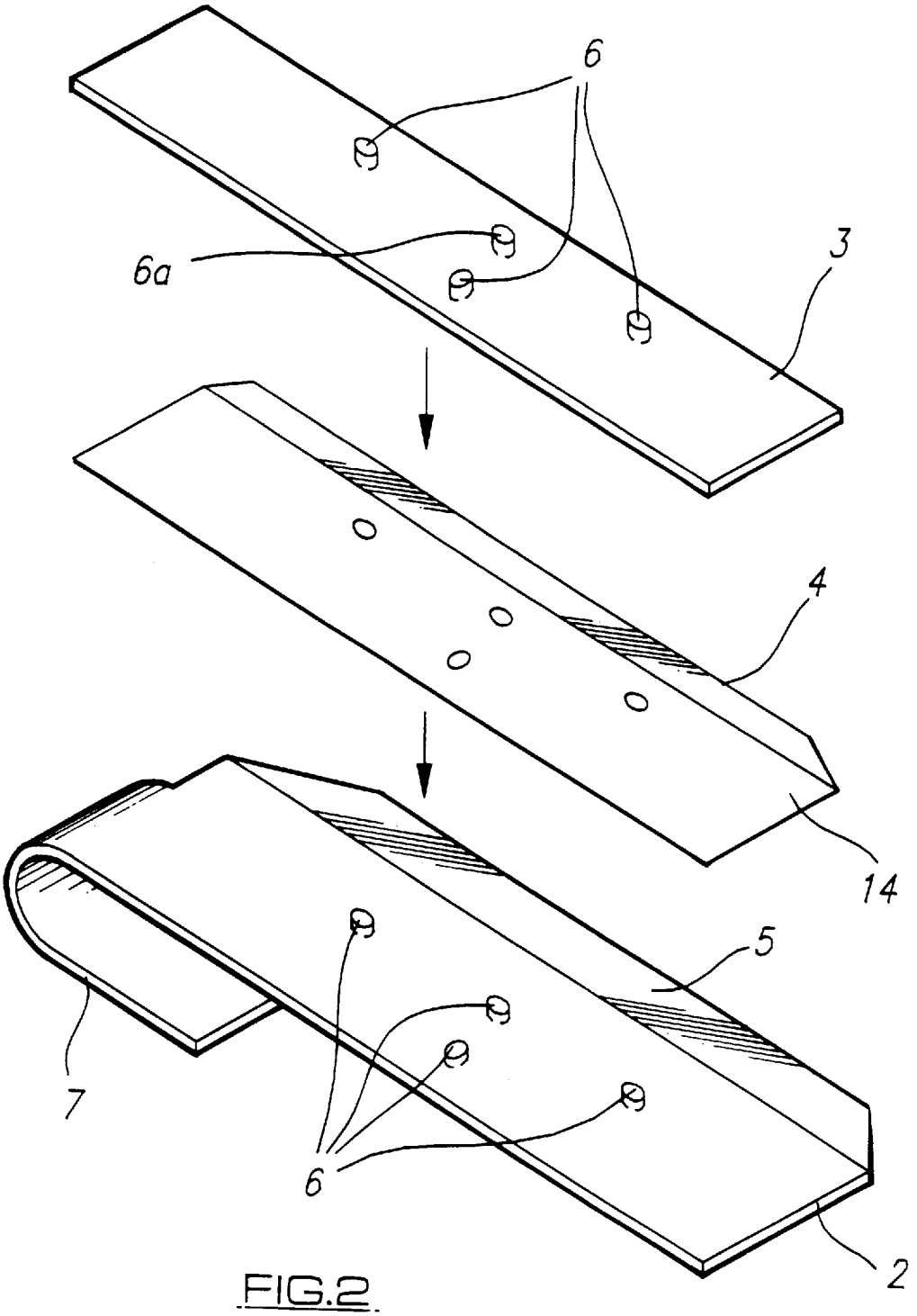
FIG. 2 shows an exploded view of the device according to the invention.

Referring to FIGS. 1 and 2, the support device 1 includes a support plate 2, a raised flange 4 extending from a face of the support plate 2 and a spacer plate 3 which lies on the support plate 2 clamping the flange 4 into the position shown in FIG. 1. The raised flange 4 is part of an alignment plate 14 which is upturned along one edge to form an L-shaped section. The upturn forms the raised flange 4 which extends perpendicularly away from the rest of the alignment plate 14. The alignment plate 14 lies on the support plate 2 so that the raised flange 4 projects outwardly from the surface of the support plate 2.

The support plate 2, alignment plate 14 and spacer plate 3 each have a series of corresponding through-holes 6 which permit passage of a nail, screw or other fixing means therethrough.

The support plate 2 also includes a hook or handle 7 which enables the support device 1 to be hung on a belt and to be easily manipulated by the user. Once the support device 1 has been attached, the hook 7 can be used to support tools such as a power screwdriver. The handle 7 may be formed by bending part of the support plate 2 into a U-shape, or by attaching a handle made separately from the support plate 2.

The spacer plate 3 and raised flange 4 lie on only a part of the support plate 2. The rest of the support plate 2 has the function of assisting in supporting a second panel of plasterboard during attachment. The second panel temporarily rests on the support plate 2, and to assist in placing the edge of the second panel on to the support plate 2, the support plate 2 includes a lip 5 which is angled to present a deeper slot for insertion of the second panel.

The term "second panel" herein refers to the panel which is to be fixed.

The raised flange 4 has an added purpose in that when attached, measurements may be more accurately taken from the edge of a fixed panel 12 since the tab of a tape measure may be inserted between the fixed panel 12 and the raised flange 4.

FIG. 2 shows the construction of the support device very clearly. In this embodiment, the support plate 2, the alignment plate 14 and the spacer plate 3 are each made of sheet steel. However, it might be cheaper and more effective to make the parts from other materials such as plastics, or to make the whole or part of the device in the form of an extrusion cut into lengths. The handle 7 could then be attached separately. The raised flange 4 is the part which is most easily damaged by being dropped, and this could be made to be replaceable.

Figure 3:
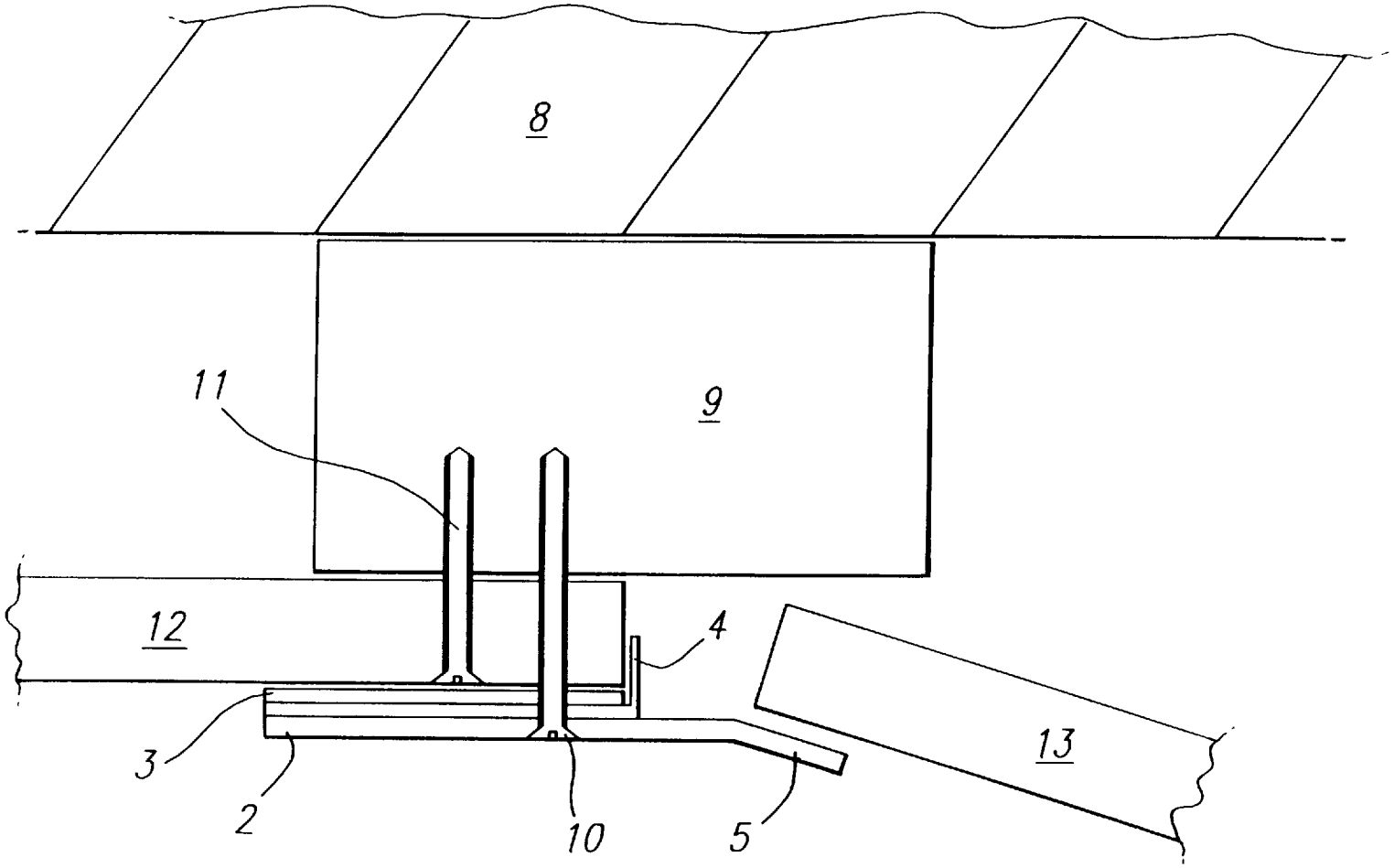
FIG. 3 shows a sectioned view of the device attached against a fixed panel, and a panel to be supported being inserted into the device.
Figure 4:
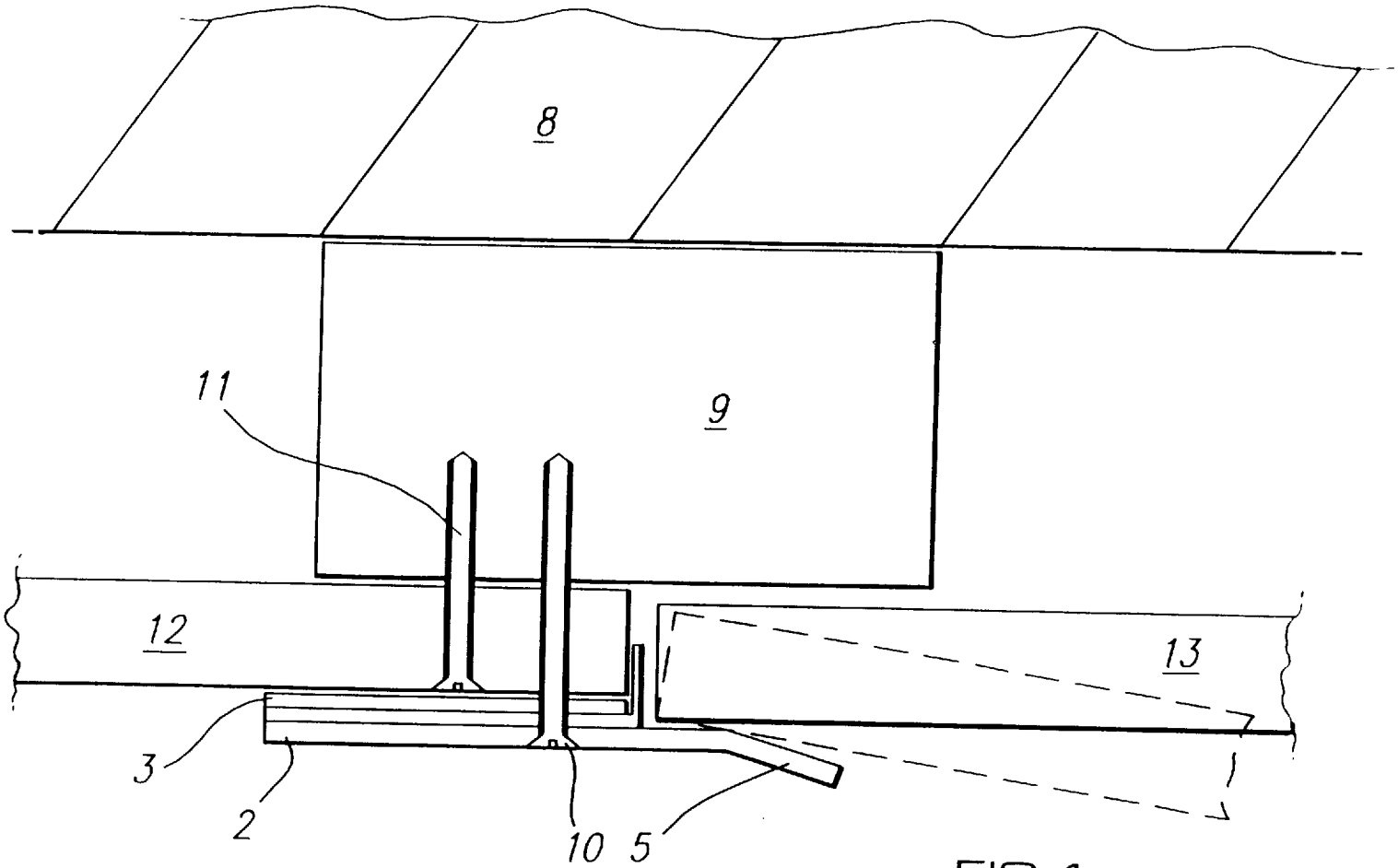
FIG. 4 shows a sectioned view of the device attached against the fixed panel, and the second panel being offered into place.
Figure 5:
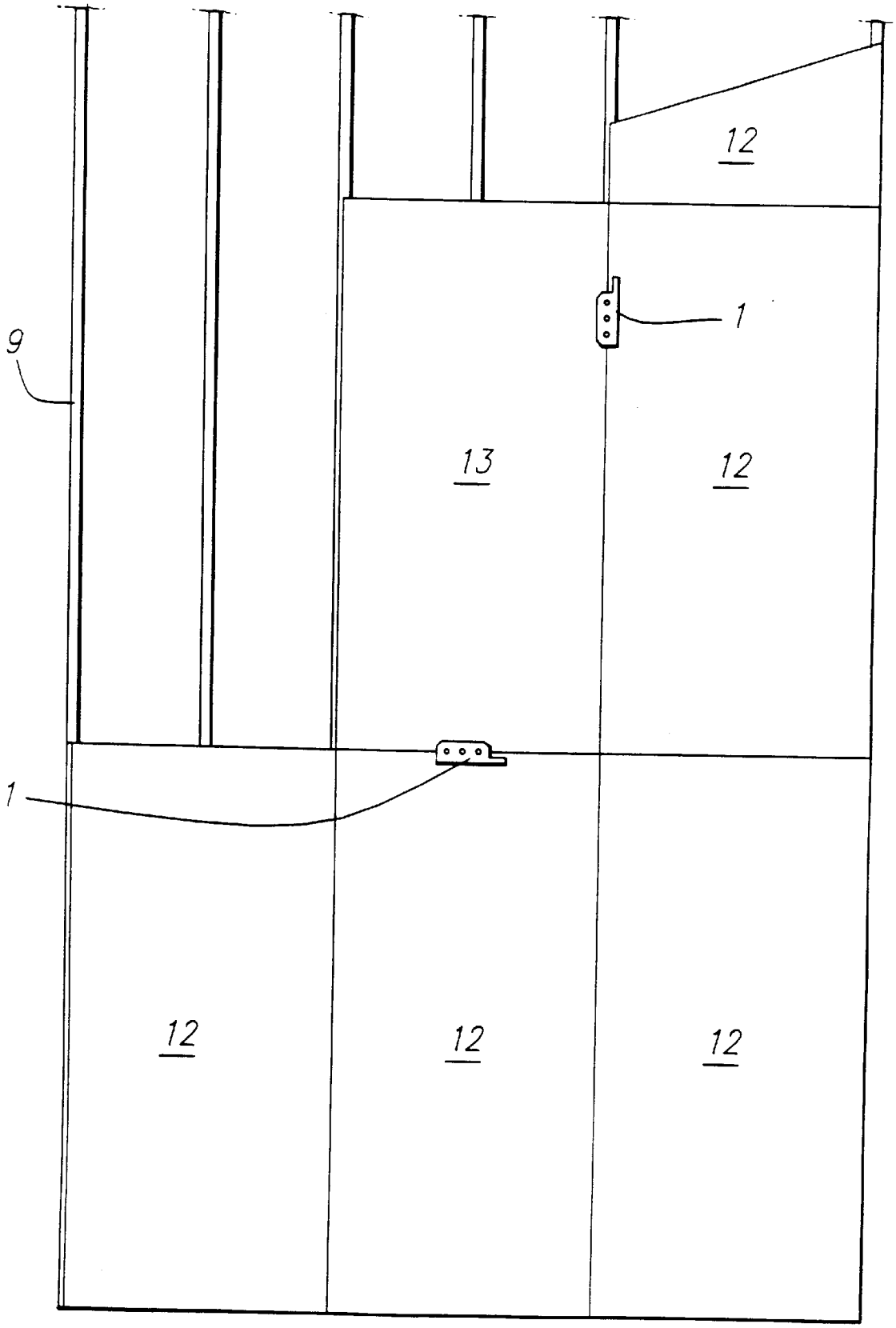
FIG. 5 shows the second panel supported on a wall by two devices of the present invention.
Figure 6:
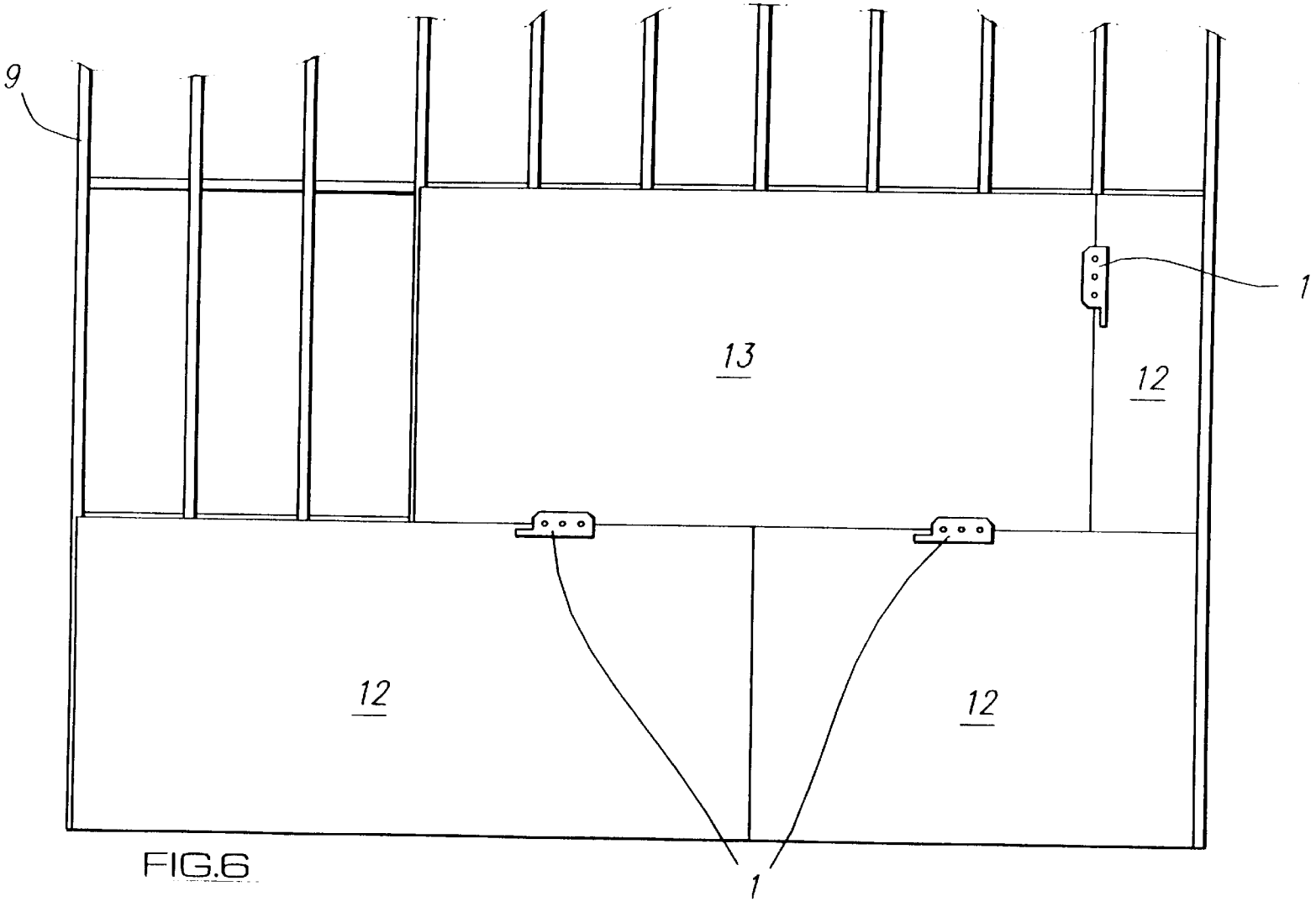
FIG. 6 shows a panel supported on a sloping wall or soffit by devices of the present invention.

Referring to FIGS. 3 and 4, the attachment of a second panel of plasterboard to a wall, ceiling or partition 8 will be described.

Framework member 9 may be attached to a structure such as a ceiling or wall 8 to permit attachment of the plasterboard thereto. The framework members 9 are arranged to run parallel to each other, the distance between subsequent members 9 permitting each panel of plasterboard to abut at the approximate mid point of the frame member 9. Once a fixed panel 12 of plasterboard has been attached, it is simple to use the support device of the present invention. The fixed panel 12 may be a small 'rip' panel which is easy to handle and takes very little time to put up. A fixed panel 12 is shown in FIGS. 3 and 4, attached to the framework member 9 by a screw 11, nail or other fixing means.

The support device 1 is placed against the fixed panel 12 with the spacer plate 3 lying flat against the fixed panel 12, and the raised flange 4 abutting the edge of the fixed panel 12. The raised flange 4 aligns the support device 1 so that the holes 6 line up with the frame member behind the fixed panel. The support device 1 is then nailed or screwed against the fixed panel 12 by one or more nails or screws 10 passing through the holes 6, through the fixed panel 12 and into the frame member 9. The support device 1 is therefore securely supported.

The second free panel of plasterboard 13 can then be supported by the support device 1. An edge of the second panel 13 is pushed across the lip 5 and on to the support plate 2 where the second panel 13 rests. Once the second panel 13 abuts against the raised flange, the plasterboard panel 13 is positioned as shown in FIG. 4 into its final position. The second panel 13 may then be screwed against the frame members 9 and, once securely attached, the support device is unnailed or unscrewed and moved along ready to support the next successive panel.

One great advantage of the present invention is that the nails or screws 10 pass through the plasterboard and into the frame members 9 very easily. The device takes only a few seconds to attach to the frame members 9, and a few seconds to remove, but makes attachment of the panel 13 much quicker and easier.

It is expected that this device will permit a fixing job to be completed in less time than the job would take using conventional methods.

Figure 9:
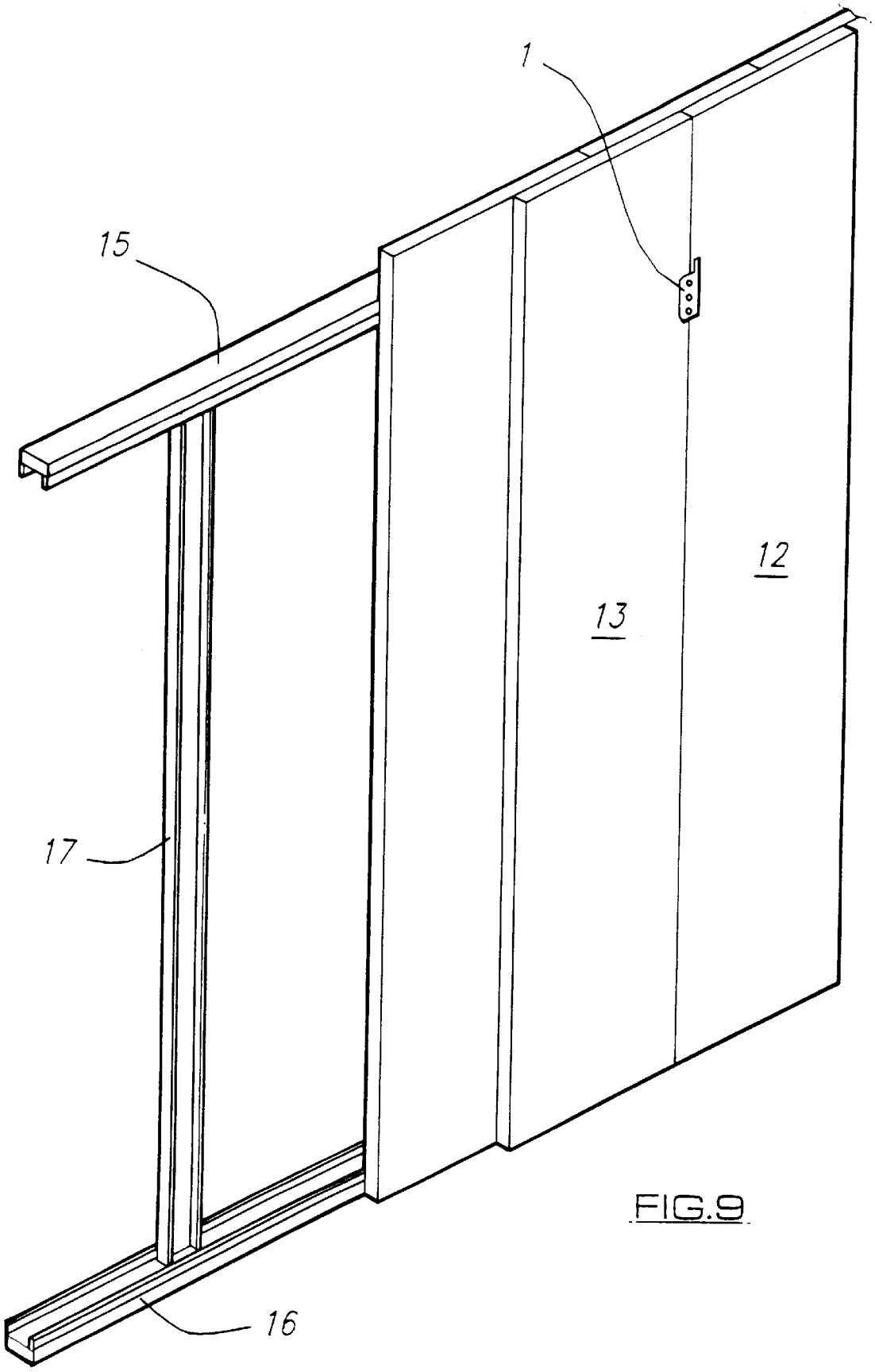
FIG. 9 shows a second panel supported in a second layer with the framework constituted from a head track, a floor track and studs between the tracks.

The present invention will permit the use of larger plasterboard panels since they are easier to support. Furthermore, as shown in FIG. 9, many walls, ceilings and partitions require multiple layers of plasterboard to achieve a required specification. Since the raised flange does not extend from the support plate any further than the thickness of one plasterboard panel, the only difference required is the use of longer nails or screws 10 which must pass through two or more panels of plasterboard before reaching the frame member 9.

In many situations it is advantageous to use more than one support device so that the plasterboard panel is more securely supported by the support device. FIGS. 5 to 8 show examples of this.

In FIGS. 5 to 8 it is optional whether more than one support device 1 is used depending on the size of the panel and experience of the fixer.

Also in FIGS. 5 to 9, the holes 6 through the support device 1 are shown. In this embodiment four holes 6 are included, three of which are in a line so that a nail or screw 10 will pass through each hole 6, through the fixed plasterboard panel 12 and into the frame member 9 behind. The fourth hole 6 provides support where the frame member 9 runs perpendicularly to the support device 1 and the outer two holes 6 of the row of three holes 6 will not engage with the frame member. In practice, it has been found that generally only one nail or screw 10 is required passing through the most central hole 6*a*.

It might be expected that, once the support device 1 has been removed, the raised flange 4 will leave substantial gaps between panels. The raised flange 4 should be of minimal thickness. The support device 1 assists the fixer in aligning the panel more accurately thereby reducing the possibility of large or uneven panel gaps.

This embodiment of the invention relates to temporary support of part of a plasterboard panel, but may equally effectively be applied to mounting other types of panel or other sheet material.

Figure 7:
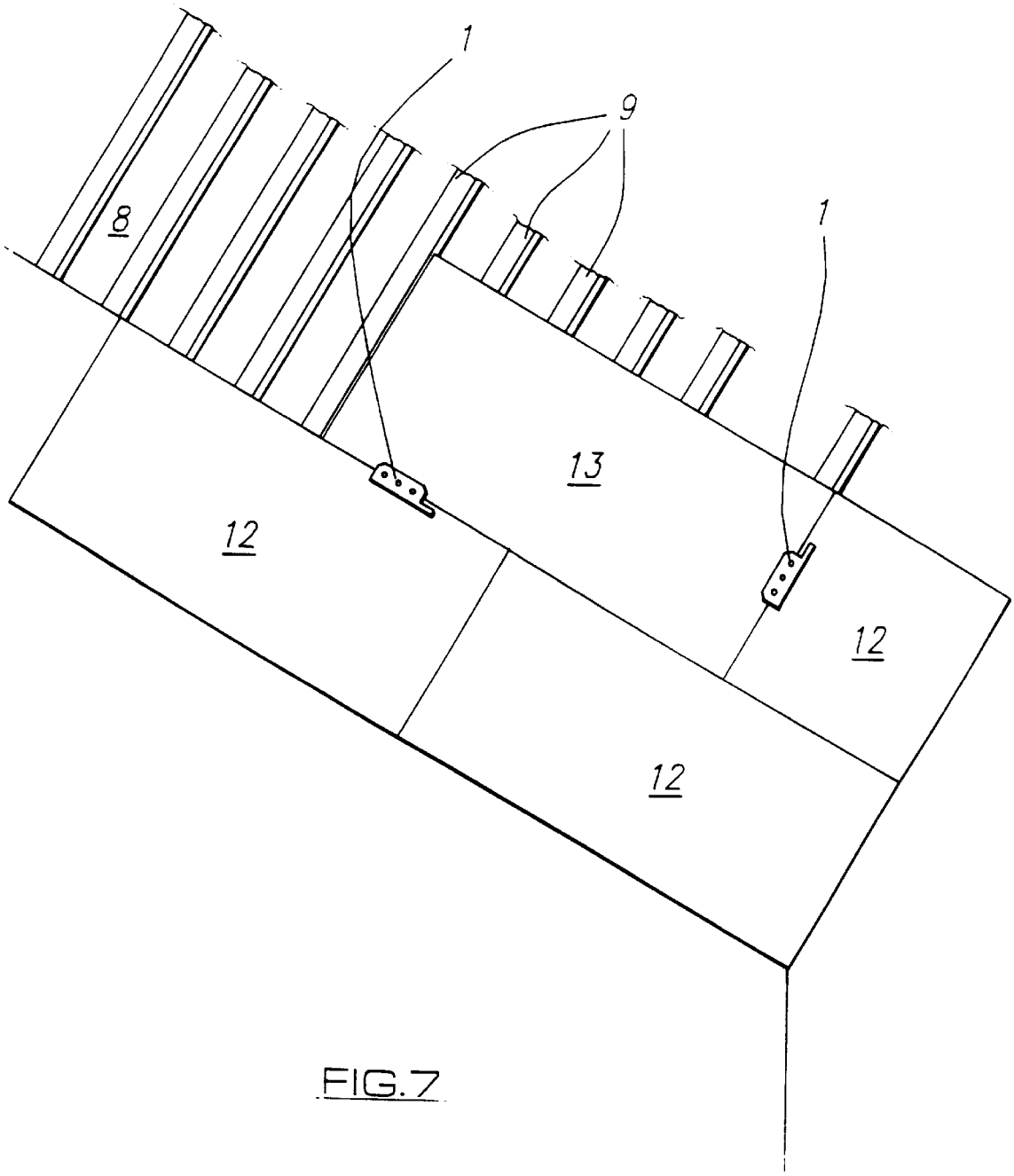
FIG. 7 shows two support devices supporting a second panel on a ceiling.

FIG. 7 shows two devices 1 supporting a second panel 13 on a ceiling. It is particularly useful to use two or more support devices in this situation, particularly if the fixer is not experienced in fixing plasterboard. An experienced fixer might only require a device 1 located to support an end of the panel 13.

Figure 8:
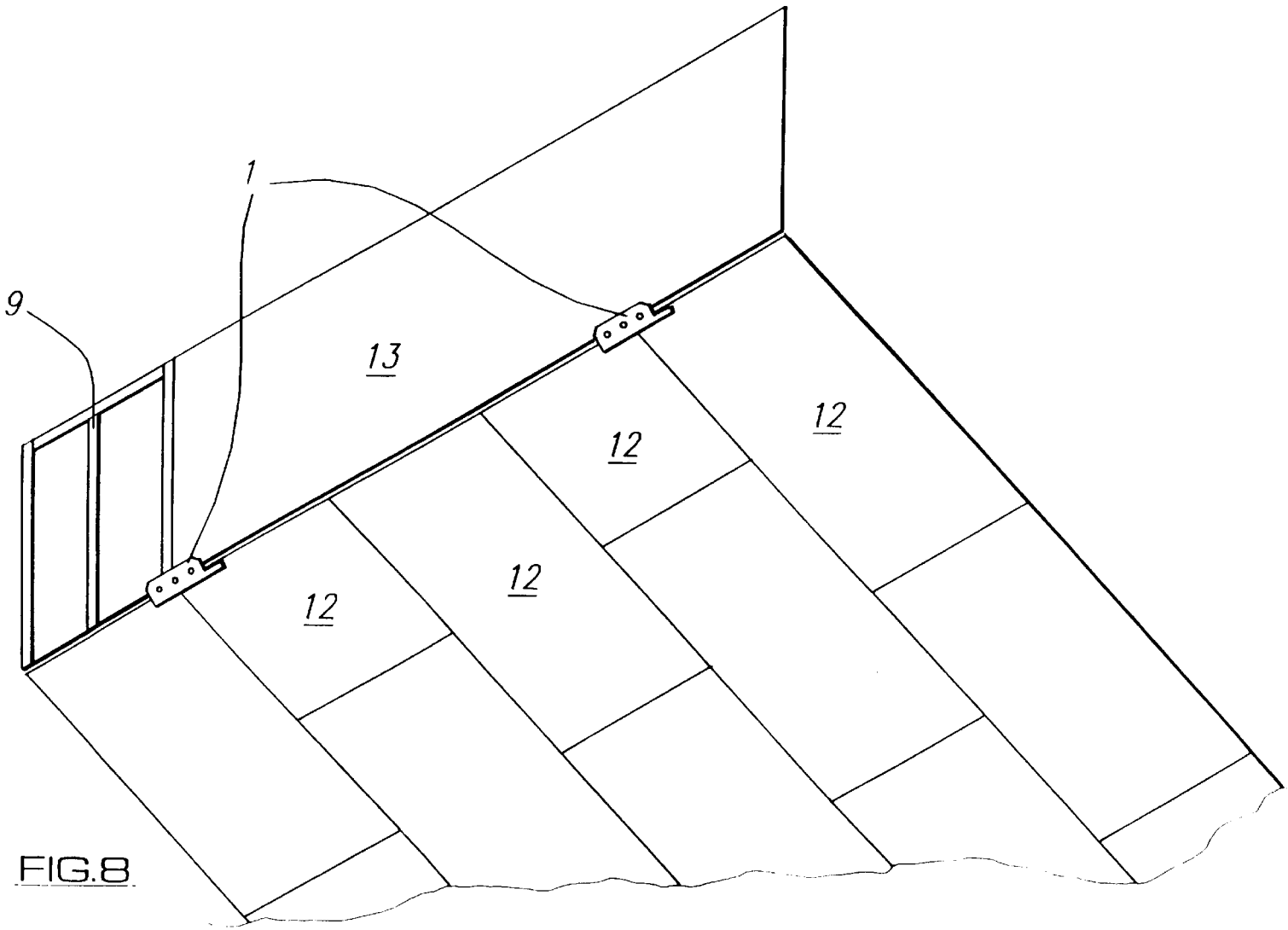
FIG. 8 shows two devices supporting a second panel upstanding from a horizontal soffit.

FIG. 8 shows a panel 13 being supported in an upstanding position from the ceiling. The upstanding position is frequently used where the ceiling height increases e.g. leading to a skylight.

FIG. 9 shows a support device 1 supporting a panel 13 in edge to edge relationship with a fixed panel 12 to form a second plasterboard layer. The plasterboard is fixed to a framework including a head track 15, a floor track 16 and stud 17.

Figure 10:
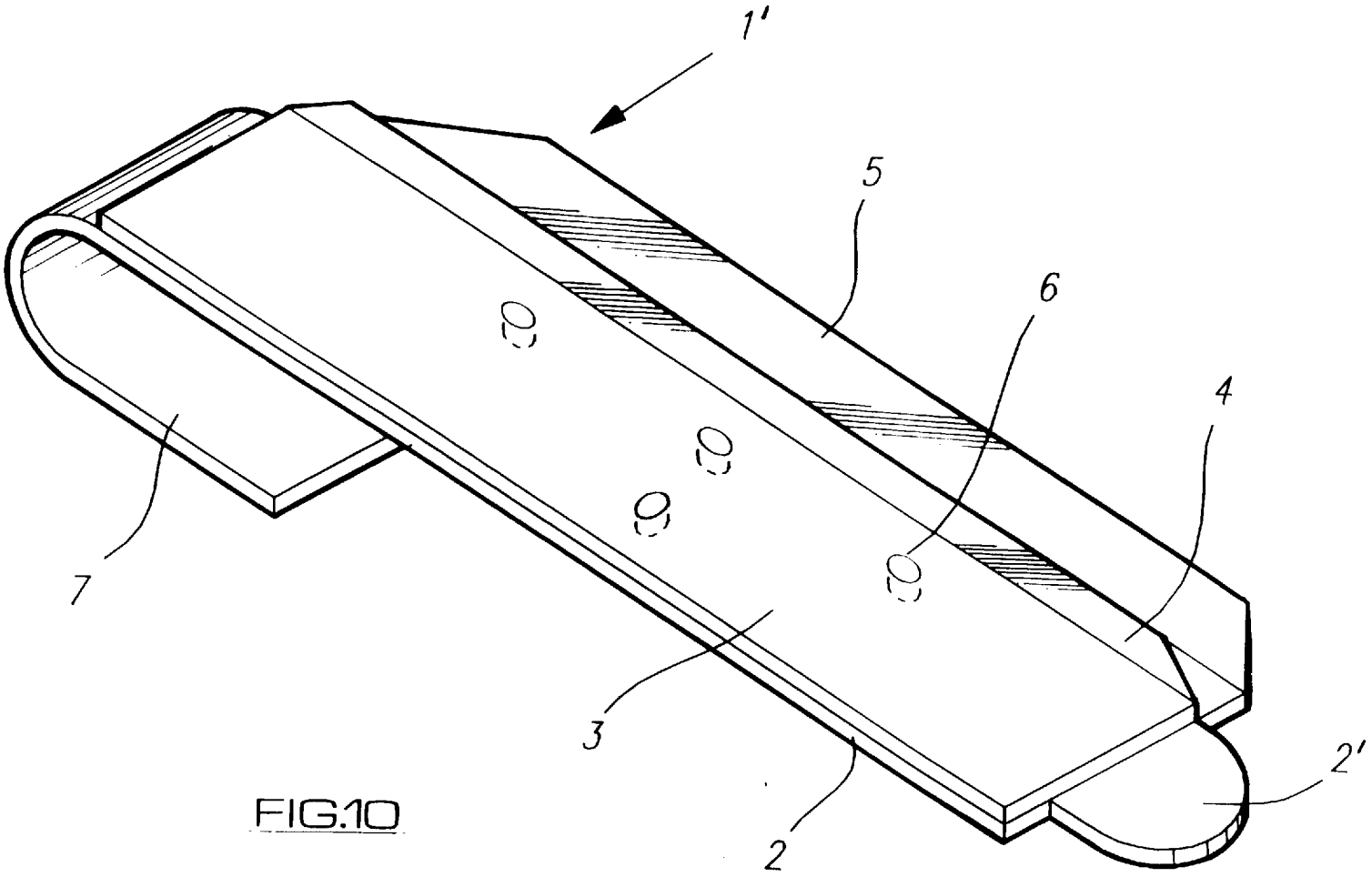
FIG. 10 shows a perspective view of a modified form of the embodiment of device shown in FIGS. 1 and 2.

Referring now to FIG. 10, here is shown a modified form of the embodiment of device described above in relation to FIGS. 1 and 2.

This modified device 1' comprises all the components of the embodiment of FIGS. 1 and 2, namely, the support plate 2, spacer plate 3, flange 4, lip 5, through-holes 6, 6*a* and a handle or hook 7. However, it also comprises an extension 2' of the support plate 2, which extension 2' protrudes from the end of the support plate 2 remote from the U-shaped portion of the hook or handle 7. If the hook or handle 7 is formed separately from the support plate 2, then the extension 2' may be formed as part of the hook or handle 7, such that it protrudes from the end of the device 1' remote from the U-shaped portion of the handle or hook 7. In this case, the separate handle or hook 7 may be secured to the underside of the support plate 2 so that it extends therealong.

In either case, the extension 2' provides means whereby the device 1' can be levered from the fixed panel 12 to which it is temporarily secured, for example, by nail. Such levering can be effected by locating the claw portion of a claw hammer, or other suitable lever means, between the extension 2' and the fixed panel 12 to which the device 1' is temporarily secured and from which the extension 2' is slightly spaced, and then levering the device 1' from that panel using the hammer or other lever means in a levering action.

I claim:

1. A reusable support device for temporarily supporting a second panel in a common plane and in edge-to-edge relationship with a fixed panel, which panels are accessible from only one common side thereof during use of the device, the device comprising:

a support plate having a first side and a second side;

attachment permitting means adapted to permit the support plate to be temporarily attached to the fixed panel from said one common side;

spacer means disposed on the support plate and adapted to space the support plate from the fixed panel;

a flange upstanding and extending across the support plate between said first and second sides, said flange adapted to abut an edge of the fixed panel to align the support plate with respect to the fixed panel so that said second side of the support plate extends beyond the edge of the fixed panel for supporting the second panel on the support plate in a common plane with the fixed panel, and said flange adapted to be abutted by an edge of the second panel such that the two panels are in edge-to-edge relationship with each other with the flange protruding between the panels not more than the thickness of the panels; and a lip extending in an angle from said second side of the support plate for assisting in placing the second panel on the support plate, wherein the support plate is adapted to be detached from the fixed panel from said one common side, for reuse of the device after the second panel has been secured permanently by other means in said relationship with the fixed panel.

2. A reusable support device according to claim 1, wherein said attachment permitting means includes holes through the support.

3. A reusable support device according to claim 1, wherein the flange is adapted to align said attachment permitting means with the fixed panel.

4. A reusable support device according to claim 1, wherein said spacer means is adapted to space the support plate away from the fixed panel for assisting in placing the second panel between the support plate and a support member to which the fixed panel is secured.

5. A reusable support device according to claim 1, wherein the support plate is adapted to be attached through the fixed panel to a framework member to which the fixed panel is secured and which overlaps the edge of the fixed panel.

6. A reusable support device according to claim 5, wherein the flange is adapted to align said attachment permitting means with the framework member.

7. A reusable support device according to claim 1, wherein the support plate and flange are formed integrally.

8. A reusable support device according to claim 1, wherein the support plate and said spacer means are formed integrally.

9. A reusable support device according to claim 1, including a handle for enabling the device to be manipulated easily by a user.

10. A reusable support device according to claim 9, wherein the handle is formed by a bent part of the support plate.

11. A reusable support device according to claim 9, wherein the handle is U-shaped.

12. A reusable support device according to claim 9, wherein the handle is at one end of the device.

13. A reusable support device according to claim 1 including means adapted to lever the support plate, and hence the device, from a fixed panel to which the support plate is temporarily attached.

14. A reusable support device according to claim 13, wherein said levering means comprises an extension of the support plate, which extension protrudes from the support plate.

15. A reusable support device according to claim 14, wherein the extension protrudes from an end of the device.

16. A reusable support device according to claim 15, wherein the extension protrudes from the end of the device remote from a U-shaped portion of a handle of the device.

17. A reusable support device according to claim 1, wherein the device is constructed from metal sheet.

18. A reusable support device according to claim 1, wherein the device is constructed from plastics material.

19. A reusable support device according to claim 1, wherein the device is formed from an extrusion.

20. A reusable support device according to claim 1, wherein the device is molded.

21. A reusable support device according to claim 1, adapted for assisting in supporting plasterboard panels on walls, ceilings or soffits.

22. A reusable support device according to claim 11, adapted for assisting in supporting a rigid sheet material.

23. A method of temporarily supporting a second panel in a common plane and in edge-to-edge relationship with a fixed panel using a reusable support device according to claim 1, which method comprises:

bringing the flange into abutment with an edge of the fixed panel, to align the support plate with respect thereto so that the support plate protrudes from the edge of the fixed panel;

temporarily attaching the support plate to the fixed panel from said one common side;

bringing an edge of the second panel into abutment with the flange to support the second panel in said relationship with the fixed panel; and detaching the support plate, and hence the device, from the fixed panel after securing the second panel by other means in said relationship.

24. An installation for temporarily supporting a second panel in a common plane and in edge-to-edge relationship with a fixed panel for subsequent permanent securement of the panels in said relationship, the installation comprising:

a framework member attached to a structure;

a fixed panel secured to the framework member with an edge of the fixed panel extending longitudinally of the framework member between opposed longitudinal edges thereof;

a reusable support device according to claim 1, which device has its support plate temporarily attached to the fixed panel with its flange abutting an edge of the fixed panel, such that the support plate of the device is aligned with respect to the fixed panel, whereby the support plate extends beyond said edge of the fixed panel; and a second panel which is supported by the support plate extending beyond said edge of the fixed panel and which has an edge abutting the flange of the support device, whereby said panels lie in a common plane and in edge-to-edge relationship with each other with the flange protruding between the panels not more then thickness of the panels;

wherein the support plate of the support device is adapted to be removed from the fixed panel for reuse of the device after the second panel has been secured permanently to the framework member in said relationship with the fixed panel.

25. An installation according to claim 24, wherein the support plate of the reusable support device is also removably attached to the framework member through the fixed panel.

* * * * *